United States Patent [19]

Reitknecht

[11] 4,135,831

[45] Jan. 23, 1979

[54] LAMINATED FOUNTAIN TOOTHBRUSH WITH BARRIER

[76] Inventor: Jack Reitknecht, 210 E. Broadway H-503, New York, N.Y. 10002

[21] Appl. No.: 759,268

[22] Filed: Jan. 14, 1977

[51] Int. Cl.[2] ..... A46B 11/02

[52] U.S. Cl. ..... 401/175; 401/182

[58] Field of Search ..... 401/175, 171–174, 401/176–182, 143, 286, 270

[56] References Cited

U.S. PATENT DOCUMENTS

| | | | |
|---|---|---|---|
| 1,918,069 | 7/1933 | Wallace | 401/182 |
| 3,039,476 | 6/1962 | Reitknecht | 401/175 |
| 3,728,035 | 4/1973 | Reitknecht | 401/175 |
| 3,891,127 | 6/1975 | Fernandez | 401/175 X |

*Primary Examiner*—Stephen C. Pellegrino

*Attorney, Agent, or Firm*—Clarence A. O'Brien; Harvey B. Jacobson

[57] ABSTRACT

A fountain toothbrush including an elongated tubular housing with a tubular insert held captive therein for receiving toothpaste with a brush head attached to the discharge end thereof and a mechanism associated with the opposite end for causing the toothpaste to be discharged upon rotation of an operating knob with the structure of the insert including a barrier to passage of moisture from the toothpaste to the atmosphere and a barrier to passage of air or oxygen from the atmosphere to the toothpaste thereby maintaining the toothpaste in a hygienic condition with the viscosity thereof also being maintained at a desired level for optimum discharge characteristics of the toothpaste to the bristles on the brush head.

13 Claims, 7 Drawing Figures

LAMINATED FOUNTAIN TOOTHBRUSH WITH BARRIER

BACKGROUND OF THE INVENTION

1. Field of the Invention

The present invention generally relates to a fountain toothbrush and more particularly to such a toothbrush which is of laminated construction and provided with a barrier to passage of moisture, air, oxygen, and the like, to or from the toothpaste contained in the toothbrush.

2. Description of the Prior Art

Fountain toothbrushes of various types are known in which a manually operated mechanism is employed to discharge toothpaste from a container or reservoir onto the bristles of a brush head. My prior U.S. Pat. No. 3,728,035, issued Apr. 17, 1973, discloses a structure of this type and my prior U.S. Pat. No. Des. 233,574, issued Nov. 12, 1974, illustrates a subsequent development in this field. While such prior devices perform satisfactorily, in some instances, dehydration of the toothpaste has occurred due to migration of moisture to the surrounding atmosphere especially when stored for a prolonged period of time.

Another problem which has occurred in some instances is oxygen permeation from the atmosphere to the toothpaste which may result in deterioration of the toothpaste.

Still another problem has been the absorption of water content by the walls of the packaging and separation of the components of dentrifice or other materials, resulting in chemical reaction destructive to the contents and harmful to the ultimate consumer. The latter brought about by the chemical reaction with polymers in unprotected plastic fabrications.

SUMMARY OF THE INVENTION

An object of the present invention is to provide a fountain toothbrush which includes an external housing receiving a tubular insert for the toothpaste, a brush head at one end of the housing for receiving toothpaste from the insert and a mechanism at the opposite end of the housing for ejecting or causing discharge of toothpaste onto the brush head in which the toothpaste has a continuous barrier throughout the periphery thereof which is impervious to the passage of moisture and air.

Another object of the invention is to provide a fountain toothbrush in accordance with the preceding object in which the insert and brush head are screw threadedly interconnected and the housing is provided with an inwardly disposed flange or ledge captively retained between the insert and the brush head to maintain assembly of the components.

Still another object of the present invention is to provide a fountain toothbrush in accordance with the preceding objects in which the brush head is provided with a unique closure slide for a discharge opening and an insert which forms a continuation of the insert in the housing to provide a continuous barrier for the toothpaste.

A still further object of the invention is to provide a reciprocal closure on a bristled brush head in area of egress which in conjunction with insert and other structure will hold the unit air tight and water tight.

Yet another object of the invention is to provide a fountain toothbrush in accordance with the preceding objects in which the insert for the housing and the toothbrush head is of metallic construction and the components are so constructed that they may be provided in kit form for assembly by the ultimate consumer with a tool being provided to facilitate insertion of the insert into the housing and assembly of the housing, insert and brush head.

A further object of the invention is to provide a fountain toothbrush having an external housing, preferably of plastic material, which may include various indicia, pictorial illustrations, slogans, trademarks, advertising material, and the like.

A still further object of the invention is to provide a fountain toothbrush in accordance with the preceding objects which will effectively prevent migration of moisture from the toothpaste and migration of oxygen or air to the toothpaste thereby maintaining the quality of the toothpaste over a relatively long shelf life with the entire structure being relatively inexpensive to manufacture, thereby rendering the device economically feasible as well as providing a convenient supply of toothpaste and a toothbrush which is effective and provides a unique combination of a supply of toothpaste and a toothbrush to enhance dental care.

A further object of this invention is to provide a fountain toothbrush having a construction enabling mechanized assembly and filling.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figures 1, 2, 3, 4, 5:
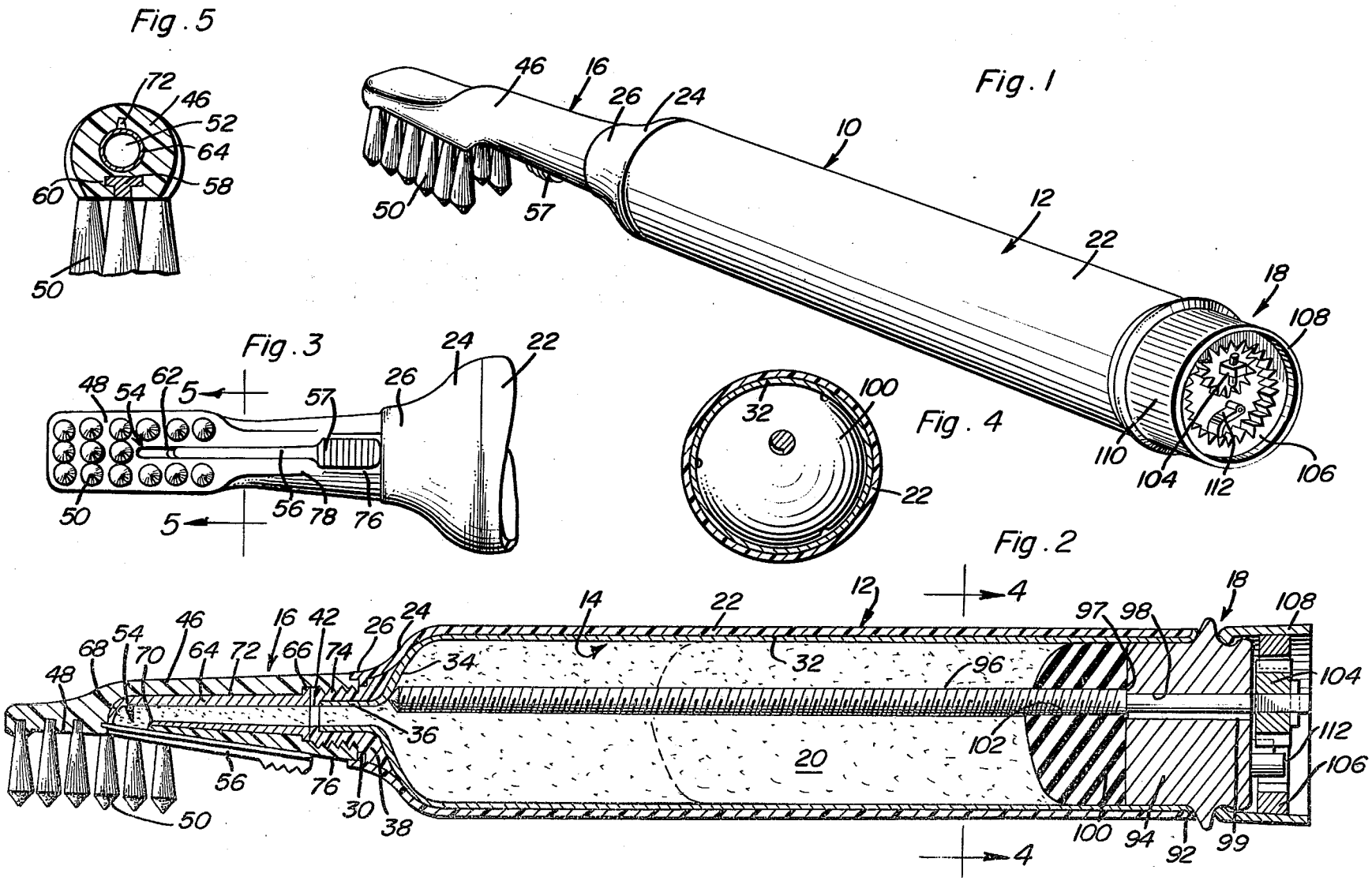
FIG. 1 is a perspective view of the fountain toothbrush of the present invention.
FIG. 2 is a longitudinal sectional view of the toothbrush.
FIG. 3 is an enlarged fragmental view of the toothbrush head illustrating the slide closure.
FIG. 4 is a transverse section view taken substantially upon a plane passing along section line 4—4 of FIG. 2 illustrating the construction of the housing and the insert therein receiving the toothpaste.
FIG. 5 is a transverse, sectional view, on an enlarged scale, taken substantially upon a plane passing along section line 5—5 of FIG. 3 illustrating further structural details of the brush head including the insert and slide closure.
Figures 6, 7:
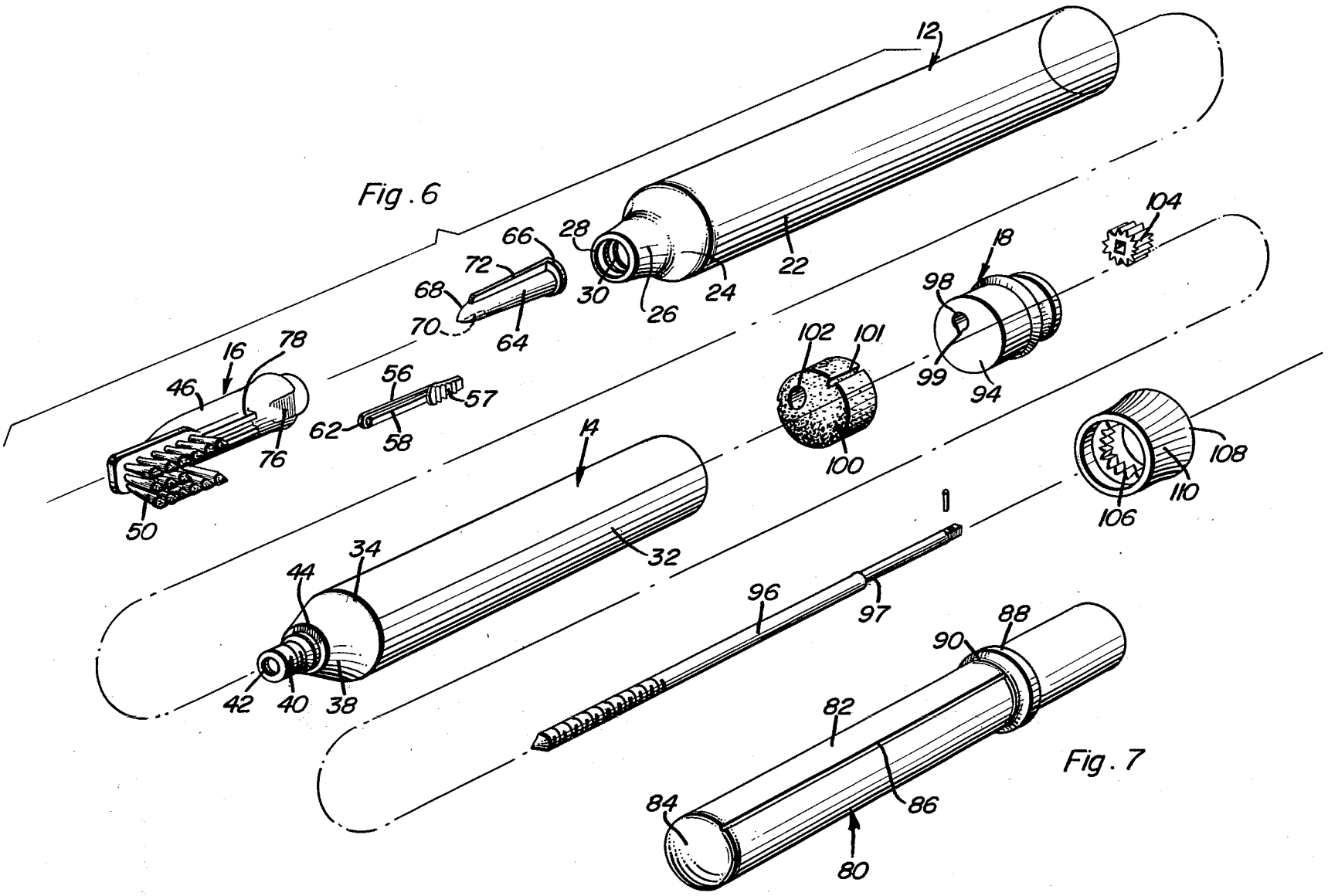
FIG. 6 is an exploded group perspective view of the components of the toothbrush.
FIG. 7 is a perspective view of an insert tool to facilitate positioning of the insert in the housing and assembly of the components.

Referring now specifically to the drawings, the fountain toothbrush of the present invention is generally designated by reference numeral 10 and includes a cylindrical housing 12, an insert 14, a brush head 16, and a closure cap and discharge mechanism 18 for receiving a quantity of toothpaste 20 of conventional formulation having the usual viscosity or flow characteristics, such as found in various commercially available toothpastes.

The housing 12 includes an elongated cyindrical body 22 preferably constructed of a substantially rigid, molded or extruded plastic material with one end of the body 22 including a rounded and inwardly curved end wall 24 which terminates in a tubular neck 26 terminating in a circular open end 28 which has a center coincidental with the center of the body 22. The end wall 24 and neck 26 are smoothly curved in their transitional areas as illustrated in FIG. 2 and the neck 26 is provided with an inwardly extending peripheral flange or ledge 30 which is spaced inwardly from the open end 28 a relatively short distance as illustrated in FIG. 2. The interior of the neck 26 is also generally cylindrical with the surfaces of the flange or ledge 30 being perpendicular to a center axis of the body 22 with the inner edge of the flange or ledge 30 defining a circular discharge opening.

The insert 14 also includes a generally cylindrical body 32 closely received in the housing 12. One end of the cylindrical body 32 is provided with an inwardly curved end wall 34 terminating in a generally cylindrical neck 36 which extends through and is concentric with the neck 26 on the housing 12. The exterior of the neck 36 and a portion of the end wall 34, as illustrated in FIG. 2, is provided with a coating or encapsulation of plastic material 38 which is externally threaded at 40 with the outer end of the plastic material 38 extending inwardly into overlying relation to the end of the neck 36 as designated by numeral 42 in FIG. 2. Also, the plastic material 38 is provided with a shoulder 44 which is larger than the threaded portion 40 and abuts against the inner surface of the flange 30 when the insert 14 is inserted fully into the housing 12. The external surface of the end wall 34 of the housing and the plastic encapsulation 38 thereon conforms with the interior surface of the end wall 24 and neck 26 and the external diameter of the threaded end portion 40 is such that it will just clear the internal diameter of the flange 30 in the neck 26 of the housing 12 so that when the insert 14 is in the housing 12 the external surface of the insert 14 including the plastic encapsulation 38 will closely fit and be received in the housing 12 with the threaded end portion 40 projecting beyond the end of the neck 26 to provide an attaching means for the brush head 16.

The brush head 16 includes a longitudinally extending hollow body 46 of tapering and rounded construction with one surface thereof being flat as indicated by numeral 48 with a plurality of tufts of bristles 50 embedded therein in a conventional manner so that the bristles 50 are generally perpendicular to the surface 48. The interior of the body 46 is hollow, as designated by numeral 52, with the hollow interior communicating with an opening or discharge orifice 54 disposed centrally of the bristles 50 for discharge of toothpaste 20 through orifice 54 onto the bristles 50. A slide closure 56 is reciprocally mounted on the exterior of the body 46 in alignment with the bristles 50 for closing orifice 54. The closure 56 includes a knurled or ribbed handle portion 57 at one end thereof and is in the form of an elongated member 58 of T-shaped configuration, as illustrated in FIG. 5 which is slidably received in a correspondingly shaped groove or channel 60 formed in the body 46. The tip end of the member 58 is rounded as at 62 to sealingly conform with and engage the laterally extending portion of the orifice 54, thus forming a closure for the hollow interior 52 through the brush head body 46. The passageway 52 is also provided with an insert 64 having a peripheral flange 66 at its larger end and tapering toward the end thereof associated with the orifice 54 with the tapering end including a curved end portion 68 terminating in an opening 70 in alignment with the discharge orifice 54. The longitudinal portion of the insert opposite from the opening 70 is provided with a projection or keel 72 which engages with the corresponding groove in the hollow interior 52 to properly locate the discharge opening 70 in relation to the orifice 54 when the insert 64 is placed in the brush head body 46, with the flange 66 on the brush head body 46 being engaged with the inwardly extending end 42 of the encapsulation 38. The end of the brush head body 46 remote from the bristles is internally threaded as at 74 and abuts against the outer surface of the flange or ledge 30 when threaded into engagement with the externally threaded portion 40 of the insert 14. The peripheral end of the brush head 46 is substantially flush with the neck 26 of the housing body 22 when the inserts 14 and 64 housing 12 and brush head 16 are assembled. The surface of the brush head body 16 which receives the slide closure 56 is disposed inwardly of the periphery of the neck 26 as indicated by numeral 76 to form a stop or limit for opening movement of the slide closure 56 when it abuts the neck 26. However, when the brush head is disassembled from the housing and insert 14, the slide closure 56 then may be removed by longitudinal sliding movement thereof along the surface area 76. The groove or channel 60 which receives the T-shaped member 58 terminates at a shoulder area 78 which is spaced from the neck 26 and defines the recessed surface area 76. The entire structure of the brush head is smoothly contoured and tapers to conform with the configuration and size of the neck 26 other than in the area 76.

A dowel-type tool 80 is provided for inserting the insert 14 into the housing 12 with the tool including a cylindrical member 82 having a rounded nose 84 and a longitudinal slot 86 therein which enables air passageway therethrough when inserting the tool into the insert 14. The length of the tool is substantially the same as the insert 14 and a flange 88 is provided thereon with a curved or inclined surface 90 to engage with the cylindrical end of the insert body 32 so that the terminal end of the body 32 will be slightly outwardly flared, as at 92, when the insert is placed into the housing 12. The outward flare 92 and the association of the ledge 30 with the insert 14, insert 64 and brush head 16 provide mechanical capture of the components thus providing a positive interconnection for the components so that the assembly can be filled with toothpaste prior to assembly of the end cap and mechanism 18.

The closure cap 18 is in the form of a cylindrical plug 94 inserted into the insert 14 in sealed relation with a threaded rod 96 having a shoulder 97 which defines a reduced end portion rotatably extending through an eccentric passageway or bore 98 therein with the shoulder 97 abutting the plug 94 to prevent reciprocal movement of the threaded rod 96. The threaded rod 96 terminates adjacent the end wall 34 and includes a plunger 100 threaded onto the rod 96 with the plunger 100 including an internally threaded, eccentric bore 102 so that upon rotation of the threaded rod 96, the plunger 100 will be reciprocated for forcing toothpaste from the discharge orifice 54 when the slide closure 56 is open. The plunger 100 (piston) has three grooves 101 and cylindrical plug 94 has one thin knife-edge cut or groove 99 in the wall of round hole 98. The small grooves 101 and cut 99 provide for trapped air to escape (venting) when open end is filled and mechanism 18 is inserted and sealed at end remote from brush head. Further venting is provided by groove 99 acting alone when ultimate consumer operates mechanism for explusion of contents by providing air intake at movement and/or displacement of piston in operation. The rod 96 extends beyond the plug 94 and is provided with an external pinion gear 104 thereon which is slightly spaced from plug 94 to provide for air venting through groove 99. Gear 104 is in meshing engagement with an internal gear 106 formed integrally with an operating knob 108 having an outwardly flared external surface 110 which may be longitudinally ribbed or grooved to facilitate gripping thereof. A resilient ratchet pawl 112 is mounted on the plug 94 and engages with the internal gear 106 to retain the knob 108 in rotatably adjusted position and to enable it to rotate in a clockwise direction but preventing it from rotating in a counterclockwise direction.

The fountain toothbrush of the present invention may be provided in a kit form with the consumer assembling the components into operative condition or the device may be provided in assembled form. The insert 14 and insert 64 are preferably of metal construction and captively held in lamination with other parts. This makes kit assembly, etc. possible. Further, the hereinbefore described construction enable easy conversion to automation (assembly and filling). Laminating by use of epoxy or other laminating materials or procedures may be resorted to when a more expensive product is desired. Depending upon the toothpaste formulation, the complete interior of the device in contact with the toothpaste may be provided with a film of plastic material, or the like, to preclude chemical reaction between the formulation of the toothpaste and the metallic material of the insert 14 or plastic material of any suitable color. The size characteristics of the toothbrush may vary but the size thereof should be convenient to enable the device to be easily handled during the toothbrushing operation.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A fountain toothbrush comprising a housing of elongated cylindrical configuration, a cylindrical insert means in said housing for receiving toothpaste and forming a barrier to migration of moisture and air in relation to the toothpaste therein, a brush head connected to one end of said housing and insert means, said brush head including a plurality of bristles thereon, a passageway extending from the bristles to the insert means for guiding toothpaste onto the bristles, and insert means in said way forming a barrier to migration of moisture an air in relation to the toothpaste in the passageway, and closure means for the passageway where it communicates with the bristles to form a sealed container for the toothpaste, said insert means being captively retained in the housing and passageway, said housing including a generally cylindrical neck having an internal flange therein, said insert means in said housing including a threaded neck formed by plastic material encapsulating a portion of the insert means and a shoulder at the inner end of the threaded neck engaged with the flange on the housing, said brush head including an internally threaded end portion engaged with the threaded neck of the insert means in the housing and in captive engagement with the opposite side of the flange from the shoulder thereby securing the brush head, housing and housing insert means together in assembled relation.

2. The structure as defined in claim 1, wherein said closure means includes a longitudinally disposed slidable closure member mounted on the brush head, said brush head including a longitudinally extending groove slidably receiving the closure member, said closure member including a handle portion adjacent the threaded end portion of the brush head and a rounded tip for closing engagement with the periphery of the passageway.

3. The structure as defined in claim 2, wherein said insert means in the passageway in the brush head includes a longitudinal projection thereon, said passageway in the brush head including a longitudinal recess receiving the projection on the insert means for properly positioning the insert means in relation to the passageway during assembly, said insert means in the passageway including a flange engaged with the outer end of the threaded neck on the insert means in the housing to provide a continuous barrier around toothpaste disposed interiorly of the toothbrush.

4. The structure as defined in claim 3, together with a tool for inserting the housing insert means into the housing, said tool comprising an elongated shank generally conforming in shape and size to the interior of the insert means, a peripheral flange on said shank for engaging the end of the insert means remote from the threaded neck to enable the shape of the insert means to be maintained during insertion into the housing.

5. The structure as defined in claim 4 wherein said flange on the inserting tool includes an inclined surface to form an outward flare on the end of the insert means to rigidify the end portion of the insert means and cooperate with the brush head to captively retain all components in secure relationship when the tool is withdrawn from the insert means.

6. The structure as defined in claim 2 wherein said groove and slidable closure member are provided with a mortise joint along the sides and tip end thereof to provide an airtight and watertight seal for the brush head.

7. A fountain toothbrush comprising a housing of elongated cylindrical configuration, insert means captively retained in said housing for receiving toothpaste and forming a barrier to migration of moisture and air in relation to the toothpaste therein, and a brush head connected to one end of said housing and insert means, said brush head including a plurality of bristles thereon, a passageway extending from the bristles to the insert means for guiding toothpaste onto the bristles, and closure means for the passageway where it communicates with the bristles to form a sealed container for the toothpaste, said housing including a generally cylindrical neck having an internal flange therein, said insert means including a threaded neck extending through the flange and including a shoulder at the inner end thereof engaged with the flange, said brush head including an internally threaded end portion engaged with the threaded neck of the insert means and engaged with the opposite side of the flange from the shoulder thereby captively securing the insert means in the housing.

8. The structure as defined in claim 7 wherein said insert means includes a generally cylindrical hollow body engaged with the inner surface of said housing and being of metallic construction to form a barrier between the housing and toothpaste.

9. The structure as defined in claim 7 wherein said passageway in the brush head includes insert means forming a barrier between the inner surface of the passageway and toothpaste therein.

10. The structure as defined in claim 9 wherein said insert means in the passageway includes a tubular member having a peripheral flange on the end thereof engaging the end of the neck on the insert means in the housing when the brush head is threaded thereon.

11. The structure as defined in claim 10 wherein said tubular member in the passageway is of metallic construction to form a barrier between the brush head and toothpaste therein.

12. The structure as defined in claim 7 wherein said closure means for the passageway includes a slide member mounted in longitudinal guide means on the brush head, said slide member having its outermost surface disposed below the ends of the bristles and including an actuating end disposed adjacent the neck of the housing when the brush head, insert means and housing are assembled with the neck of the housing preventing disengagement of the slide member from the guide means while permitting longitudinal movement of the slide member between passageway opening and closing positions.

13. A fountain toothbrush comprising an elongated housing, a brush head with bristles thereon extending from one end of said housing, said brush head including a passageway therein communicating the interior of the housing with the bristles, tubular insert means in said housing for receiving toothpaste, said insert means in the housing including an open end communicating with the passageway in the brush head, tubular insert means in said passageway communicating with the open end of the insert means in the housing, closure means on said brush head for closing the passageway where it communicates with the bristles, each of said insert means being constructed of material forming a barrier to migration between the toothpaste and said housing and brush head with the adjacent ends of the insert means being engagingly associated to form a continuous barrier.

* * * * *